United States Patent [19]

Lord et al.

[11] 4,448,344

[45] May 15, 1984

[54] EGG CELL CONSTRUCTION

[75] Inventors: Henry A. Lord, Cape Elizabeth, Me.; Kenneth D. Bixler, Huntington, N.Y.; Richard F. Reifers, New Canaan, Conn.

[73] Assignee: Diamond International Corporation, New York, N.Y.

[21] Appl. No.: 413,915

[22] Filed: Sep. 1, 1982

[51] Int. Cl.[3] ..... B65D 81/16; D21J 7/00

[52] U.S. Cl. ..... 229/2.5 EC; D9/425; 162/383; 217/26.5; 229/45 EC

[58] Field of Search ..... 229/44 EC, 45 EC, 2.5 EC; 217/26.5, 27; D9/425; 425/403, 385, 386; 162/228, 383; 220/21; D7/23

[56] References Cited

U.S. PATENT DOCUMENTS

| | | | |
|---|---|---|---|
| D. 119,864 | 4/1940 | Mankki | D7/23 |
| D. 255,208 | 6/1980 | Greger | D7/23X |
| 1,969,802 | 8/1934 | Koppelman | 217/26.5 |
| 2,771,233 | 11/1956 | Cox . | |
| 2,885,136 | 5/1959 | Grant | 217/26.5 |
| 2,970,715 | 2/1961 | Kappel et al. | 220/21 |
| 3,016,176 | 1/1962 | Reifers et al. | 229/2.5 EC |
| 3,092,284 | 6/1963 | Stout | 220/21 |
| 3,128,932 | 4/1964 | Reifers . | |
| 3,145,896 | 8/1964 | Reifers et al. . | |
| 3,185,370 | 5/1965 | Reifers et al. . | |
| 3,185,615 | 5/1965 | Reifers . | |
| 3,207,409 | 9/1965 | Reifers et al. . | |
| 3,234,077 | 2/1966 | Reifers et al. . | |
| 3,275,213 | 9/1966 | Reifers . | |
| 3,325,348 | 6/1967 | Reifers . | |
| 3,362,605 | 1/1968 | Bixler . | |
| 3,767,103 | 10/1973 | Reifers . | |
| 3,813,027 | 5/1974 | Misdom, Jr. et al. | 229/45 EC |
| 4,025,038 | 5/1977 | Reifers et al. . | |
| 4,081,123 | 3/1978 | Reifers . | |
| 4,088,259 | 5/1978 | Sutton . | |
| 4,394,214 | 7/1983 | Bixler et al. . | |

FOREIGN PATENT DOCUMENTS

| | | | |
|---|---|---|---|
| 1905991 | 8/1969 | Fed. Rep. of Germany | 229/2.5 EC |

*Primary Examiner*—William Price
*Assistant Examiner*—Gary E. Elkins
*Attorney, Agent, or Firm*—Karl W. Flocks; Sheridan Neimark

[57] ABSTRACT

An egg cell base is provided to create softened areas of egg contact. The base has a center area which creates a softened cushion for egg contact and also creates a gap to shield the eggs from contact with the surface upon which the egg carton rests. Internally, the bottom is provided with a crater construction which helps distribute contact over a larger shell area, and also helps locate and hold the egg tip in place. Surrounding the central area are foot areas of greater thickness which provide strength for stacking. The ring cushion also is capable of providing an accordian motion upward to accommodate high eggs that may bulge the cover of the carton stacked therebelow during shipment.

6 Claims, 5 Drawing Figures

EGG CELL CONSTRUCTION

FIELD OF INVENTION

The present invention relates to the packaging of eggs and, more particularly, to an improved egg carton cell construction providing improved cushioning for egg cells.

BACKGROUND OF THE INVENTION

Molded pulp (fiber) egg cartons have reached a high level of sophistication as evidenced by a number of United States patents in the name of the present asignee, including the Reifers U.S. Pat. Nos. 3,128,932; 3,767,103; 4,081,123; and the Reifers et al U.S. Pat. Nos. 3,145,896 and 4,025,038. Also see the Reifers et al U.S. Pat. Nos. 3,185,370 and 3,234,077, and the Bixler U.S. Pat. No. 3,362,605. The constructions there disclosed provide highly satisfactory and desirable egg cushioning constructions which may be formed not only using molded pulp, but also other materials such as cellular plastic foam.

Nevertheless, eggs being very fragile items and commercial requirements necessitating that the eggs be packaged in the smallest possible space, the need for improvement still exists, particularly when one bears in mind that some eggs are thinner and more fragile than others.

SUMMARY OF INVENTION

It is, accordingly, an object of the invention to provide for improved packaging of eggs.

It is another object to provide for an improved molded egg carton formed with a superior egg cell base.

It is a further object of the invention to provide a cell bottom or cell base in a molded carton for the packaging of eggs having parts of varying thicknesses, such different thickness parts performing different functions.

Yet another object of the invention is to provide a molded egg cell bottom or base which better cradles the tip of the egg and distributes force over a larger area.

Still a further object of the instant invention is to provide an egg cell bottom having a thin center for better egg cushioning.

Still another advantage of the instant invention is to provide an egg carton having an egg cell base with a thick periphery for stacking strength.

These and other objects of the invention and the nature and advantages of the instant invention will be more apparent from the following general description of the invention.

A molded egg carton is provided having a cell base or bottom with a thin center area which creates a softened cushion for egg contact, which center area lies above the bottom of the carton so as to provide a gap between the bottom of the center area and a plane passing along the bottom of the carton. This gap serves to shield eggs from contact through the bottom with hard surfaces against which the carton is placed for support.

Surrounding the center area is a peripheral upward extending ring or crater which helps distribute contact of the egg bottom over a larger shell area, and also helps locate it and hold the egg tip. Beyond the ring, the cell bottom is provided with a thicker portion along the periphery of the cell bottom to provide good strength for stacking of the carton.

This ring cushion molded form of the instant invention also shares advantages of certain of the prior constructions disclosed in patents set forth above, i.e. it can "accordian" upward to accommodate unusually long eggs which may bulge the cover of the carton stacked therebelow.

BRIEF DESCRIPTION OF THE DRAWING

For a better understanding of the invention, as well as the above and other objects and the nature and advantages of the instant invention, a possible embodiment thereof will now be described with reference to the attached drawings, it being understood that this embodiment is to be intended as merely exemplary and in no way limitative.

DETAILED DESCRIPTION OF PREFERRED EMBODIMENT

Figure 1:
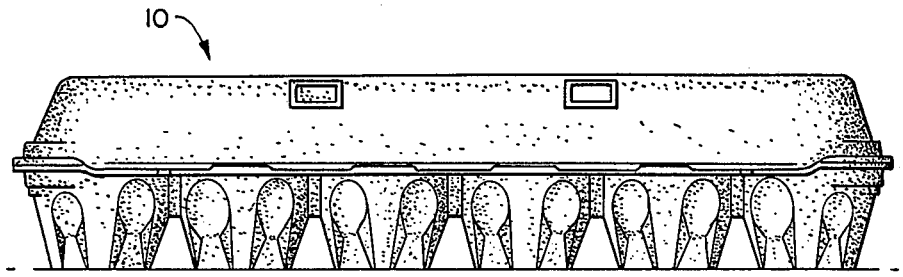
FIG. 1 shows a typical molded egg carton, in this case of U.S. Pat. No. 4,081,123, in which the egg cell bottom of the instant invention may be incorporated.

The egg cell base or bottom of the instant invention may be used in conjunction with any egg carton construction, such as the egg carton 10 of FIG. 1. Such egg cartons may be formed of myriad materials, although foam polystyrene and molded pulp, both of which are relatively soft materials, constitute the two most commonly used materials. Molded pulp egg cartons may be wet formed and then either dried without pressing, or alternatively subjectd to an after-pressing operation. Egg cartons which are not after-pressed are, of course, less expensive than those which are after-pressed. On the other hand, after-pressing normally provides a smoother and more flexible carton, and also permits an additional opportunity to provide various shapes to the carton in selected areas.

The present invention will be described in conjunction with the manufacture of a molded pulp egg carton which is not subjected to after-pressing, i.e. one in which all the desired shapes are provided during the wet molding operation. In this regard, attention is invited to copending applications Ser. No. 306,981 in the name of Bixler et al; Ser. No. 306,980 in the name of Reifers et al now U.S. Pat. No. 4,394,214; and Ser. No. 306,982 in the name of Bixler; the cell bottom construction of the present invention is especially adapted for incorporation into the constructions disclosed in these copending applications, it being understood, as indicated above, that it may be also incorporated into other egg supporting constructions such as egg trays, after-pressed molded pulp egg cartons, and foam polystyrene egg cartons.

Figure 2:
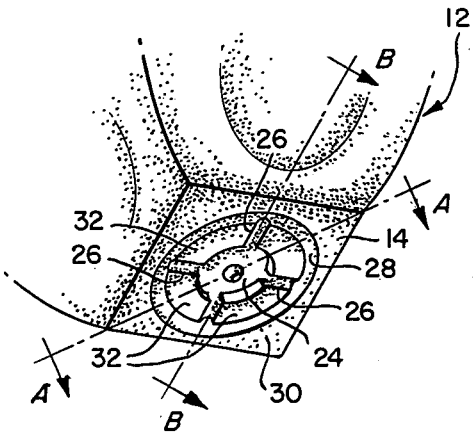
FIG. 2 is a perspective view from the bottom, outside of an egg cell in accordance with the instant invention.

In general, when cartons are made of molded pump, they are wet formed on one side of a shaped screen so that the resultant carton may be said to have a screen side, which is usually the outside of the carton, and a bark side, which is usually the inside of the carton. Thus, the outside of the carton 10 of FIG. 1 as shown is the screen side and similarly the outside of an egg cell 12 of FIG. 2 is also the screen side. It will be understood that when fibers accumulate on the screen from a water slurry, with the water then being drained through the screen, the tendency of the fibers is to form in a more or less uniform thickness, although it is also known that thin deposits of pulp will "bridge" imperforate areas of the screen, and that thinner deposits will also form along convex bends of the screen, while thicker deposits will form along concave bends in the screen. Copending application Ser. No. 306,980 now U.S. Pat. No. 4,394,214 shows the use of a mold insert to form a thin, egg-cushioning formation during wet formation of an egg carton, and an analogous technique may be used to form the desired cell bottom or base in accordance with the present invention as best shown in FIGS. 3 and 4.

Referring to FIG. 2, the egg cell 12 is provided with a configuration generally in accordance with the cell of the Cox U.S. Pat. No. 2,771,233. The cell 12 has a square bottom 14 but unlike the cell of the Cox patent '233, the sides of the square are desirably oriented at an angle of 45° to the sides and ends of the carton, and not parallel to the sides and ends of the carton.

Figure 3:
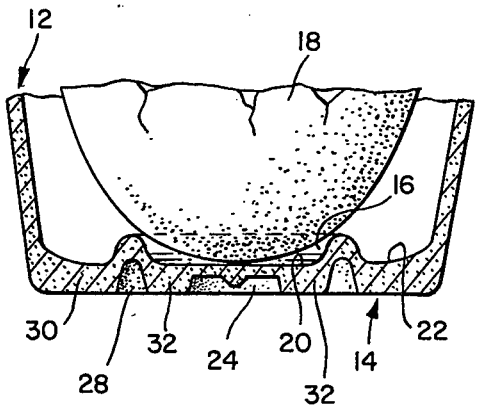
FIG. 3 is a sectional view through the cell of FIG. 2 taken along line A—A.

On the interior or bark side of the bottom 14 is provided an annular ring or crater formation 16 which, as best seen in FIG. 3, provides an enlarged surface area to cradle the tip of an egg 18 supported thereon. Within the crater 16 and along the bottom thereof is an egg-tip supporting floor 20 of variable cross-sectional thickness, and which will be described in more detail below. Outside of the crater 16 is a peripheral annular portion 22, the width of which varies from a minimum shown in FIG. 4 where the cross-section is taken across the narrowest width of the cell 12, to a maximum shown in FIG. 3 which is a diagonal cross-section.

Figure 4:
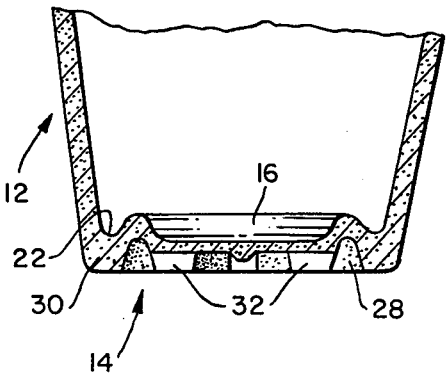
FIG. 4 is a cross-sectional view of the egg cell of FIG. 2 taken along line B—B of FIG. 2.

Looking next at the outside, or screen side of the cell as shown in FIGS. 2–4, and starting in the center, it is seen that first there is provided a generally cylindrical depression 24 from which extend radially a series of channels 26, which channels 26 terminate in a circular groove 28; it is noted that the circular groove 28 underlies the crater 16. Extending beyond the circular groove 28 and underlying the peripheral annular portion 22 is a thickened foot formation 30 which extends to the sidewalls of the cell 12. Lying between the channels 26, the circular groove 28 and the central depression 24 are a series of pedestal elements 32. As can be best seen in FIG. 3, the pedestal elements 32 and the central depression 24, as well as the radial channels 26, all underlie the egg-tip supporting floor 20.

Particularly in the center area overlying the cavity 24, the floor 20 is especially thin and provides excellent egg cushioning, while the pedestals 32 provide suitable support. The thickened foot portions 30 essentially located at the corners of the bottom 14, which are thicker than the pedestals 32, provide good stacking strength. The central depression 24 provides a gap to shield the egg tip from contact with the surface on which the egg carton rests. The crater 16 helps distribute contact of the egg shell over a larger surface area of the cell, and also helps locate and hold the egg tip. In addition, the crater 16 is able to accordian upwardly because of the great depth of the circular groove 28, and this permits accommodation to high eggs which may bulge the cover of a carton stacked below the carton in question, e.g. during shipment.

In a typical embodiment, the dimensions of the cell bottom 14 on the outside are about 22 mm by 22 mm. The depth of the circular groove 28 is about 3 mm and its width at the bottom thereof is approximately 2 mm. The diameter of the cylindrical depression 24 is about 7 mm. The width of each of the channels 26 is about 1.5 mm, and the depth of said channels 26 and the recess 24 is about 1.5 mm. Each channel 26 has a length of about 4 mm. On the inside of the cell, the crater 16 has a depth of about 2 mm and an internal diameter of approximately 14 mm.

Figure 5:
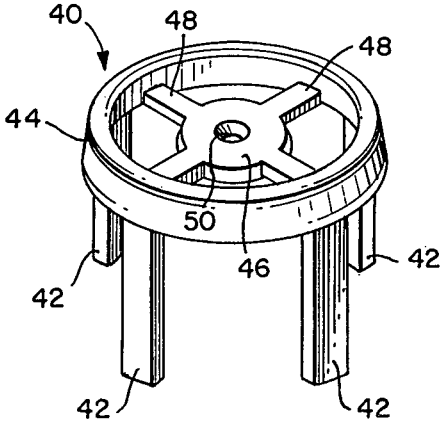
FIG. 5 is a perspective view of an insert tool for placement on the screen at the bottom of each cell-forming cavity for forming the egg cell bottom of FIGS. 2–4 of molded pulp in a wet-forming die.

The configuration of the bottom 14 of the cell 12 of the present invention may be provided in molded pulp in the wet molding operation by the use of a tool 40 such as shown in FIG. 5. The tool 40 is suitably formed of plastic and has a plurality of legs 42 extending from the bottom thereof which may be forced through the screen wire and fused so as to better adhere to the screen, thereby holding the tool 40 in place within the cell-forming cavity on the product-forming surface of the screen. The tool or foot form 40 has an annular ring 44 suitably tapered and curved as shown in FIG. 5, and therewithin a hub element 46 and four spokes 48 extending therefrom. Also provided in the hub 46 is a central tapered opening 50. As should be readily apparent, the ring 44 is what forms the circular groove 28 and the crater 16 thereabove, and the hub 46 forms the cavity 24 with the spokes 48 forming the channels 26. The tapered hole 50 assists in providing suitable drainage of water from the pulp slurry, and improves the formation of the thin central area of the floor 20 of the crater 16.

In a preferred embodiment, the height of the ring 44 is approximately 3 mm, its thickness at the top being about 1 mm and its thickness at the bottom being about 2 mm. The external diameter of the ring 44 at the top is about 18 mm. The thickness of the hub 46 and the spokes 48 is about 0.5 mm. The diameter of the hub is approximately 7 mm and the width of the spokes 48 is about 2 mm. The diameter of the tapered hole 50 is suitably 0.062 inches.

It will be obvious to those skilled in the art that various changes may be made without departing from the scope of the invention and the invention is not to be considered limited to what is shown in the drawings and described in the specification.

What is claimed is:

1. In a molded egg carton having a plurality of egg cells, the improvement wherein the bottom of a said egg cell is provided with, internally of said egg cell, a crater depression to cradle the tip of an egg resting therein, said crater being formed of a generally circular ridge encircling a depressed floor, said egg cell bottom having a thickened peripheral annular portion having an upper surface lower than the height of said circular ridge and peripherally surrounding said circular ridge, said circular ridge defining immediately therebelow and there-within a circular groove so that the circular groove faces the bottom outside of said egg cell, a central depression of diameter less than the diameter of said crater and underlying said depressed crater floor along the central portion thereof, the wall between said depressed crater floor and said depression being relatively thin to provide a softened cushion for egg tip contact, and at least one pedestal for supporting said crater floor and located between said depression and said circular groove, said pedestal being of such thickness to extend from the crater floor to the bottom outside of said cell so that the bottom of said at least one pedestal and the bottom of said thickened peripheral portion normally lie in substantially the same plane.

2. An un-afterpressed egg carton according to claim 1 formed of molded pulp.

3. An egg carton according to claim 1 or claim 2 wherein said crater has an internal diameter of about 14 mm and said depression has a diameter of about 7 mm.

4. An egg carton according to claim 3 having four said pedestals, said pedestals being separated from one another by channels having a height substantially equivalent to the height of said depression.

5. A tool for forming the bottom of a egg cell as recited in claim 1, said tool comprising a ring having a generally tapered cross-section and a height of about 3 mm, said ring having an exterior diameter at the top of about 18 mm; a central hub lying within said ring and connected to said ring by at least two spokes, said ring and spokes having a height of less than 1 mm; and a tapered hole in the center of said hub.

6. An egg carton according to claim 1 formed of a relatively soft material selected from the group consisting of molded pulp and foam plastic.

* * * * *